US005406167A

United States Patent [19]

Choi

[11] Patent Number: 5,406,167

[45] Date of Patent: Apr. 11, 1995

[54] APPARATUS FOR SHIELDING UNNECESSARY ELECTROMAGNETIC WAVES IN A MAGNETRON FOR A MICROWAVE OVEN

[75] Inventor: Byoung T. Choi, Kyungsangbuk, Rep. of Korea

[73] Assignee: Goldstar Co., Ltd., Seoul, Rep. of Korea

[21] Appl. No.: 33,150

[22] Filed: Mar. 16, 1993

[30] Foreign Application Priority Data

Mar. 27, 1992 [KR] Rep. of Korea ..... 4934/1992

[51] Int. Cl.[6] ..... H01J 1/52

[52] U.S. Cl. ..... 313/313; 315/242; 315/356; 315/85; 315/39.51

[58] Field of Search ..... 313/242, 313, 326, 356, 313/479; 315/85, 39.51; 174/35 R; 219/736, 738, 761

[56] References Cited

U.S. PATENT DOCUMENTS

| | | | |
|---|---|---|---|
| 3,728,573 | 4/1973 | Roeber | 313/356 |
| 4,156,829 | 5/1979 | Harada | 219/738 |
| 4,300,072 | 11/1981 | Tashiro et al. | 315/85 |
| 4,659,891 | 4/1987 | Yamaguchi et al. | 219/742 |
| 4,720,658 | 1/1988 | Tsuzurahara | 315/39.51 |
| 4,752,720 | 6/1988 | Oguro et al. | 315/39.51 |
| 5,021,713 | 6/1991 | Uesawa et al. | 315/39.51 |

*Primary Examiner*—Donald J. Yusko
*Assistant Examiner*—Vip Patel
*Attorney, Agent, or Firm*—Denton L. Anderson; Sheldon & Mak

[57] ABSTRACT

This invention relates to an unnecessary electromagnetic wave shielding structure of a magnetron for a microwave oven, comprising an electric wave absorbent filament ceramic disposed adjacent the lower end of a power input section to prevent unnecessary electromagnetic waves produced in an active space from being leaked from the input section through a center lead extending downwardly from an upper end shield of the active space and a side lead disposed adjacent the center lead; first and second ferrite cores having different frequency characteristics and inserted concentrically over the filament ceramics at the respective upper and lower sides of the outer periphery thereof to cooperate with the ceramics to shield the unnecessary electromagnetic waves; and an annular insulator placed between the second ferrite core and filament terminals to insulate the ferrite core from the terminals.

7 Claims, 5 Drawing Sheets

APPARATUS FOR SHIELDING UNNECESSARY ELECTROMAGNETIC WAVES IN A MAGNETRON FOR A MICROWAVE OVEN

BACKGROUND OF THE INVENTION

1. Field of the Invention

This invention relates to a magnetron used in a microwave oven to generate microwaves, and more particularly a magnetron including electromagnetic wave absorbent ferrite members provided on the outer periphery of a filament ceramics which is disposed adjacent an input section of the magnetron, so as to prevent leakage of unnecessary fundamental and higher harmonic waves (hereinafter referred to as "unnecessary electromagnetic waves").

2. Description of the Prior Art

Generally, a magnetron for a microwave oven is of the type shown in FIGS. 1 and 2 of the accompanying drawings, which includes a cylindrical anode 2 disposed within a yoke 1 serving as a frame; a cathode section comprising a coil filament 6 which is disposed about a center lead 18 to emit thermions and restrained and supported by upper and lower end shields 4,5; a power input section "A" comprising the center lead 18 and a side lead 19 and acting to apply electric power to the cathode section; an active space 7 defined by the upper and lower end shields 4,5, and a plurality of radially extending vane 3 mounted on the inner periphery of the cylindrical anode 2; a magnetic circuit section comprising magnets 8 and magnetic poles 9 and acting to apply magnetic flux into the active space 7; an output section comprising an antenna lead 10, an antenna ceramics 11 and an antenna cap 12 and acting to emit microwave energy transferred to the cylindrical anode 2 to the exterior of the magnetron; and a filter circuit section comprising a choke coil 13 and a through type condenser 14 and acting to prevent unnecessary electromagnetic waves produced in the active space 7 during oscillation of the magnetron from backflowing to the input section.

In the drawings, reference numeral 15 designates a shield case enclosing and protecting the input section and the filter circuit section, 16 designates a filament ceramics (hereinafter referred to as a "F-ceramics"), and 17 designates filament terminals (hereinafter referred to as "F-terminals").

In the magnetron thus constructed, when DC current is applied to the input section so that the magnetron performs oscillating operation, the filament 6 is heated to emit the thermions into the active space. The thermions effect cycloidal movement as they undergo the force of an electric field induced between the filament 6 and the vanes 3 and a magnetic flux applied into the active space 7 between the filament and the vanes by the magnetic poles 9 of the magnetic circuit section. The thermions thus accelerated generate microwave energy which will be received by the vanes 3. The microwave energy transferred to the vanes is discharged through the antenna lead 10 of the output section to the exterior of the magnetron so as to dielectrically heat and cook foodstuffs placed within the microwave oven. At this time, the unnecessary electromagnetic waves produced in the active space tend to be leaked out of the input section via the center lead 18 and the side lead 19.

To prevent such leakage of the unnecessary electromagnetic waves from the input section, the unnecessary electromagnetic shielding structure of a prior art magnetron comprises, as shown in FIGS. 2 and 3, the filter circuit section having the choke coil 13 and the through type condenser 14 interconnected in series, and the shield case 15 enclosing the filter circuit section, thereby shielding the unnecessary electromagnetic waves leaked out of the input section via the center and side leads.

However, the shielding structure according to the prior art fails to provide efficient and satisfactory shielding of the electromagnetic waves because the unnecessary electromagnetic wave leaked to the exterior of the magnetron via the center and side leads 18, 19 of the input section can be shielded to some extent by means of the shield case and the filter circuit section, while a substantial amount of the leaked electromagnetic waves still remain within the shield case. Further, the unnecessary electromagnetic waves may be leaked to the exterior of the magnetron through a clearance between the contact areas of the shield case 15 and the condenser 14.

As an example, when leakage of the unnecessary electromagnetic waves from the magnetron having the shielding structure as set forth above has been measured with the shield case removed, it has been found that there occurs the leakage exceeding the value of 30~40 dB which is the design criteria for leakage of electric waves.

The leaked unnecessary electromagnetic waves in the input section may cause a sparking phenomeonon and burn-out of the choke coil 13 in the shield case 15, and the electromagnetic waves leaked from the magnetion may cause radio disturbance.

SUMMARY OF THE INVENTION

With the foregoing problem of the prior art in view, it is an object of the present invention to shield unnecessary electromagnetic waves leaked from an input section of a magnetron via center and side leads by the provision of two ferrite cores, which are radio wave absorbents having different frequency characteristics, on the outer periphery of a F-ceramics disposed adjacent the input section.

To achieve the above object, there is provided according to one form of the present invention an unnecessary electromagnetic wave shielding structure of a magnetron for a microwave oven, which is provided to shield unnecessary elecromagnetic waves leaked through center and side leads located between F-terminals and a lower end of a metallic cylinder of a reduced cross-section formed concentrically with a cylindrical anode and extending downwardly of the anode, the shielding structure comprising a cylindrical F-ceramics disposed, with the center and side leads passed therethrough, between the F-terminals and the lower end of the metallic cylinder to insulate the cylinder from the terminals; first and second ferrite cores inserted concentrically over the F-ceramics at the respective upper and lower sides of the outer periphery thereof to shield the unnecessary electromagnetic waves leaked through the center and side leads; and an annular insulator placed between the second ferrite core and the F-terminals to insulate the ferrite core from the terminals.

DESCRIPTION OF THE PREFERRED EMBODIMENT

Figure 1:
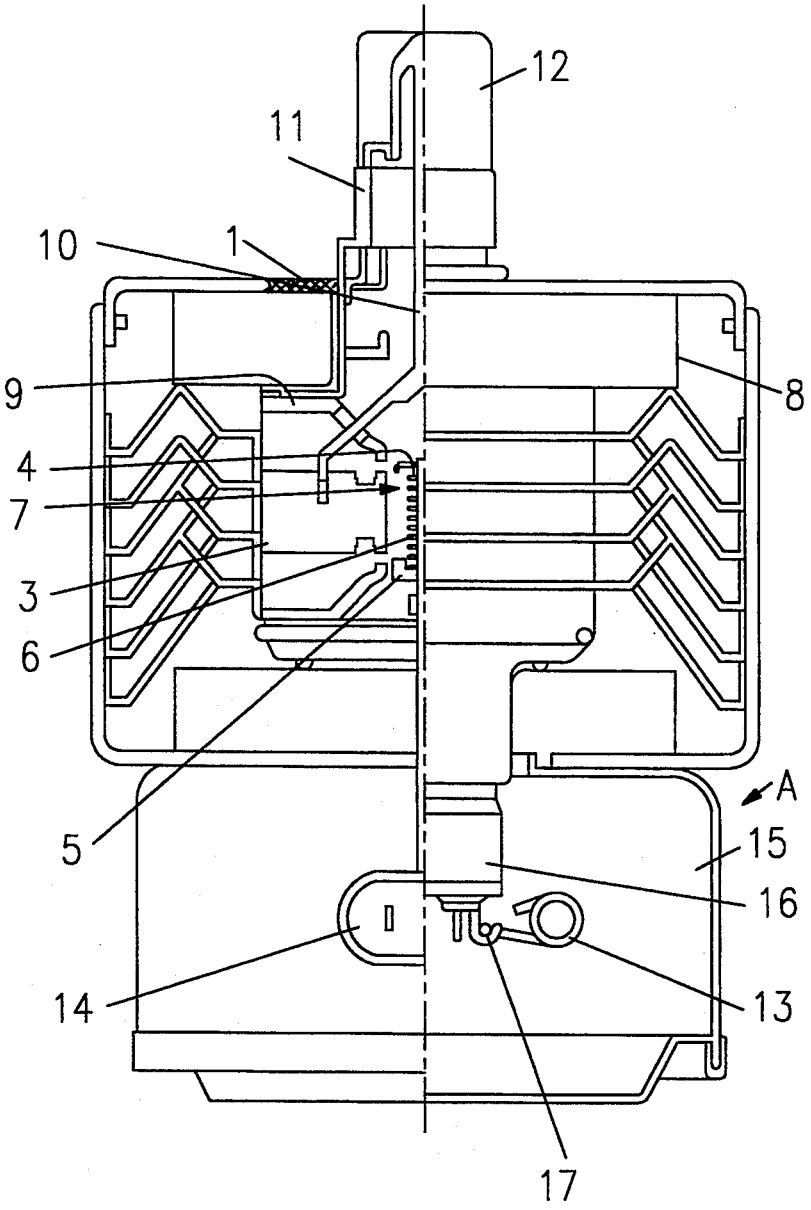
FIG. 1 PRIOR ART
FIG. 1 is a longitudinal cross-sectional view of a magnetron for a conventional microwave oven.
Figure 2:
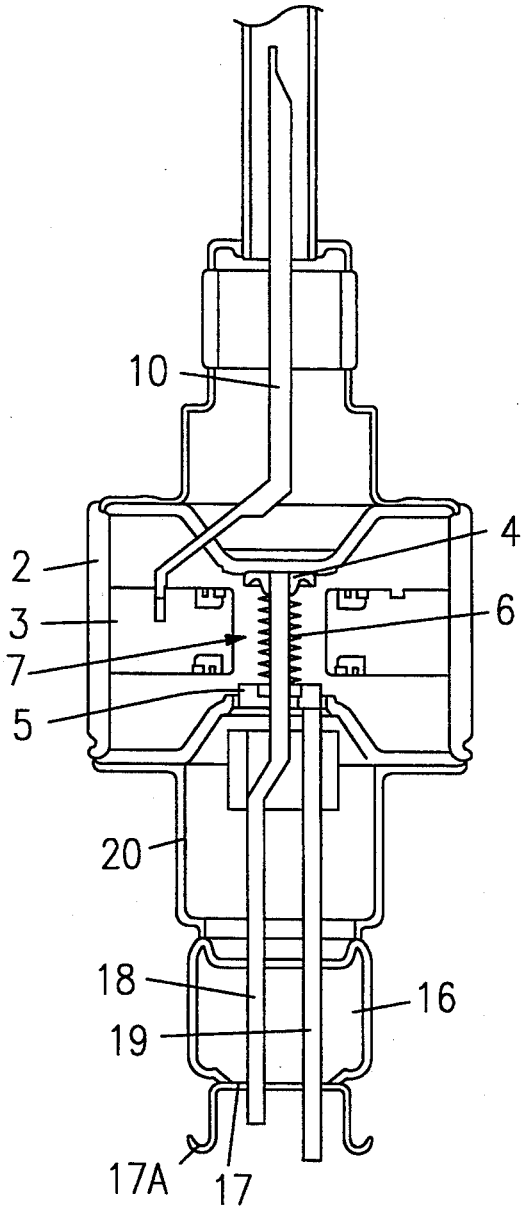
F I G. 2 PRIOR ART
FIG. 2 is a longitudinal cross-sectional view of magnetron.
Figure 3:
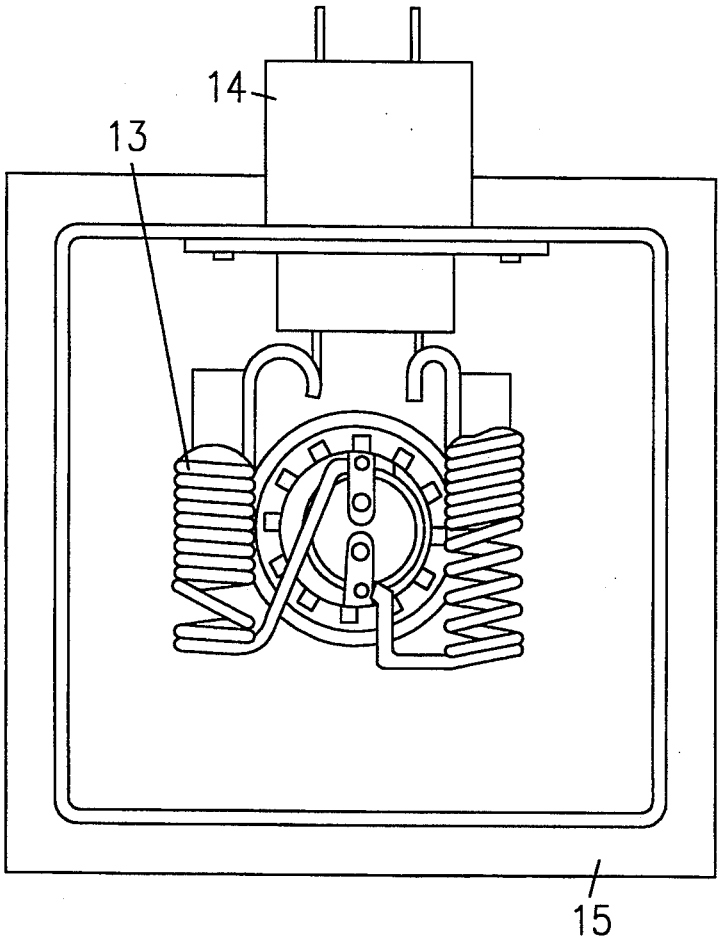
FIG. 3 PRIOR ART
FIG. 3 is a bottom view of the prior art magnetron.

The invention will now be described in detail, by way of example, with reference to FIGS. 4 to 7 of the accompanying drawings.

The general construction and operation of the magnetron according to the present invention comprising a cylindrical anode, a power input section, a cathode section, an active space, a magnetic circuit section and an output section are the same as those in the prior art as discussed above, with the exception that according to the present invention the input section is improved to prevent more effectively leakage of unnecessary electromagnetic wave. Therefore, throughout the following description parts similar to those of the prior art are denoted by similar reference numerals and the detailed description for the parts is omitted herein to avoid the duplication of explanation.

Figure 4:
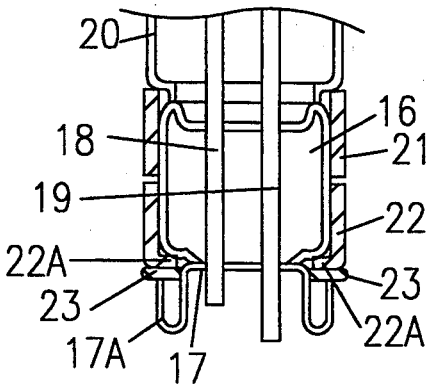
FIG. 4 is an enlarged cross-sectional view of area "A" in FIG. 1, showing an unnecessary electromagnetic wave shielding structure of the magnetron according to the present invention.

Referring to FIG. 4 showing the unnecessary electromagnetic wave shielding structure of the magnetron according to a preferred embodiment of the pesent invention, in order to prevent unnecessary electromagnetic waves produced in an active space 7 from being leakaged out through a center lead 18 and a side lead 19, a cylindrical F-ceramics 16 is disposed, with the center and side leads 18, 19 passed therethrough, between F-terminals 17 and a lower end of a metallic cylinder 20 extending downwardly or a cylindrical anode 2 to insulate the metallic cylinder from the terminals. In addition, first and second cylindrical ferrite cores 21, 22 made of materials having different frequency characteristics are inserted concentrically over the F-ceramics 16 at the respective upper and lower sides of the outer periphery thereof.

Figure 5A:
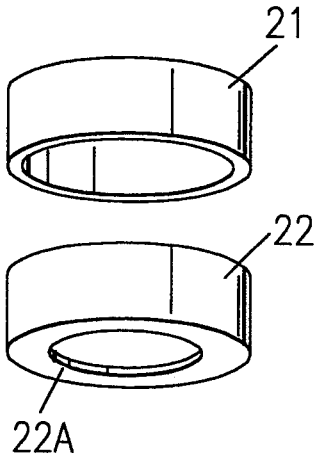
FIGS. 5*a* and 5*b* are perspective and cross-sectional veiws showing ferrite cores which are important parts of the present invention.
Figure 5B:
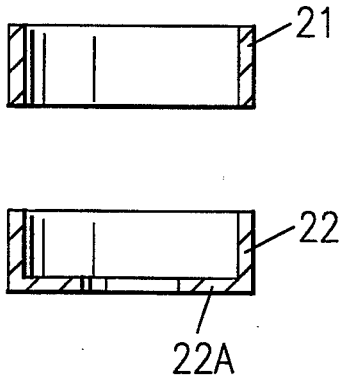

As shown in FIGS. 5*a* and 5*b*, the first ferrite core 21 is of a hollow cylindrical shape having upper and lower open ends to be easily inserted over the F-ceramics 16, and the second ferrite core 22 is of a hollow cylinder having a diameter same as the diameter of the first ferrite core 21 and has an annular support flange 22*a* formed integrally with its lower end to support the lower end of the F-ceramics 16. When mounted, the support flange 22*a* is supported by bent supports 17*a* of the F-terminals 17. At this time, an annular ring-shaped insulator 23 is placed between the annular flange 22*a* of the second ferrite core 22 and the bent supports 17*a* of the F-terminals to insulate the flange from the bent supports.

Figure 6A:
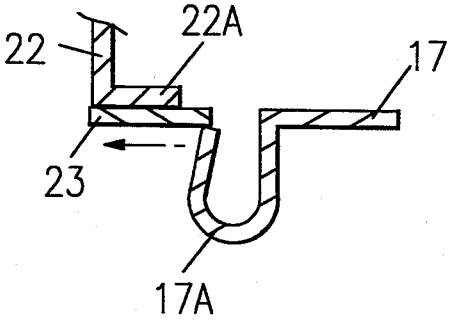
FIGS. 6*a* and 6*b* are cross-sectional views showing the assembled state of the shielding structure of the present invention before and after the insertion of the ferrite core.
Figure 6B:
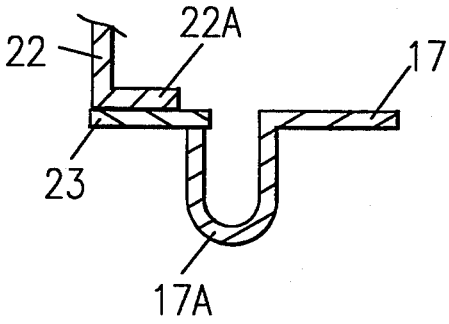

Referring to FIGS. 6*a* and 6*b* showing in section the manner of assembling the second ferrite core to the F-ceramics during assembly of the unnecessary electromagnetic wave shielding structure of the magnetron according to the present invention, first, as shown in FIG. 6*a*, in the state in which the free ends of the bent supports 17*a* of the F-terminals 17 are resiliently pushed inwardly, i.e., in a direction opposed to the direction of the arrow in the drawing, the second ferrite core 22 and the annular insulator 23 are placed over the F-ceramics 16. Then, as shown in FIG. 6*b*, when the free ends of the bent supports 17*a* are resiliently returned to their original positions, the second ferrite core 22 and the annular insulator 23 are supported in place by the bent supports 17*a* of the F-terminals 17. Thus, the assembly is completed.

Figure 7A:
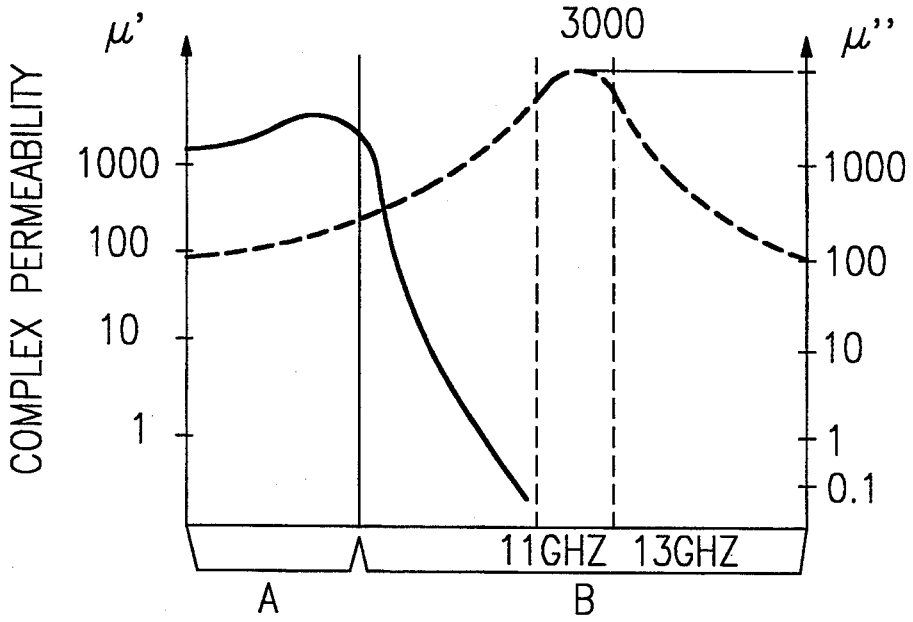
FIGS. 7*a* and 7*b* are graphs showing the frequency characteristics of the chosen ferrite cores according to the present invention.
Figure 7B:
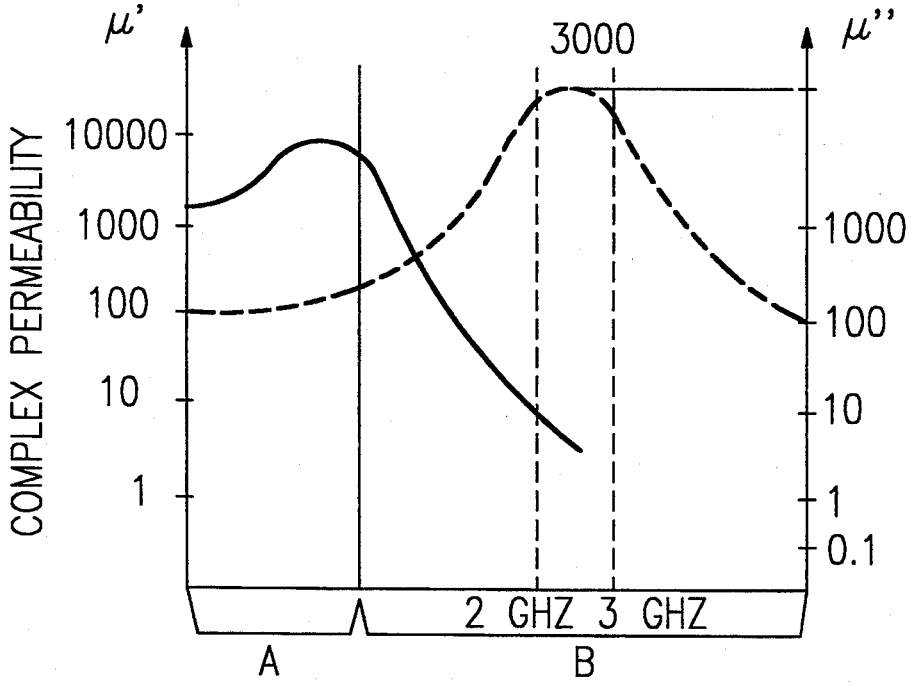

On the other hand, FIGS. 7*a* and 7*b* are graphs showing the frequency characteristics of the first and second ferrite cores. On the axis of the abscissa of each graph, the zone "A" represents a zone usable in case that magnetic permeability is utilized, and the zone "B" represents a zone usable in case that the ferrite core is utilized as an electromagnetic wave absorbent. Generally, when magnetic permeability is represented by complex permeability, it is expressed by the Equation:

$$\mu=\mu'-i\mu''.$$

Where, $\mu'$ is the permeability component (shown by the solid line in FIGS. 7*a* and 7*b*) of the ferrite core, which is used when increasing an inductance by increasing magnetic flux density of a coil, and the term of $\mu''$ is a loss term which, in case that a frequency is continuously increased, is increased while the magnetic permeability becomes approximately zero. Further, the component of $\mu''$ functions as an electric wave absorbent.

When choosing the first and second ferrite cores 21,22 according to the present invention, the first ferrite core 21 is chosen to have a value in the range of 100~3000 at the band zone of 11~13 GHz as shown by the dotted line in FIG. 7*a*, and the second ferrite core 22 is chosen to have a value in the range of 100~3000 at the band zone of 2.0~3.0 GHz as shown by the dotted line in FIG. 7*b*.

Since the first and second ferrite cores 21,22 made of materials of different frequency characteristics chosen as discussed above are inserted over the outer periphery of the F-ceramics 16, the unnecessary electromagnetic waves leaked out along the center and side leads 18,19 of the input section during oscillation of the magnetron are absorbed by the ferrite cores, so that the leakage may be reduced below the value of 30~40 dB which is the design criteria for leakage of electric waves. As a result, there may be prevented a sparking phenomenon and burn-out of the choke coil in the shield case, which may ocurr due to leakage of the unnecessary higher harmonics.

From the foregoing it will be appreciated that the present invention provides advantages over the prior art in that since two ferrite cores having different frequency characteristics are disposed on the outer periphery of the F-ceramics provided at the input section, it is possible to effectively prevent the unnecessary electromagnetic waves from being leaked from the magnetron through the center and side leads and prevent sparking of the choke coil and burn-out of the coil due to temperature rise, whereby safety and reliability of the products can be enhanced.

While the invention has been shown and described with particular reference to a preferred embodiment thereof, it will be understood that variations and modifications in detail may be made therein without departing from the spirit and scope of the invention as defined in the appended claims.

What is claimed is:

1. An unnecessary electromagnetic wave shielding structure of a magnetron for a microwave oven, which is provided to shield unnecessary electromagnetic waves leaked through center and side leads located between filament terminals and a lower end of a metallic cylinder of a reduced cross-section formed concentrically with a cylindrical anode and extending downwardly of said anode, the shielding structure comprising:

a cylindrical filament ceramics disposed, with said center and side leads passed therethrough, between said filament terminals and said lower end of said metallic cylinder to insulate said cylinder from said terminals;

first and second ferrite cores inserted concentrically over said filament ceramics at the respective upper and lower sides of the outer periphery thereof to shield the unnecessary electromagnetic wave leaked through said center and side leads; and an insulator placed between said second ferrite core and bent supports of said filament terminals to insulate said ferrite core from said terminals.

2. An unnecessary electromagnetic wave shielding structure of a magnetron for a microwave oven as claimed in claim 1, wherein said first ferrite core is of a hollow cylinder having upper and lower open ends.

3. An unnecessary electromagnetic wave shielding structure of a magnetron for a microwave oven as claimed in claim 1, wherein said second ferrite core is of a hollow cylinder having an annular support flange formed integrally with its lover end.

4. An unnecessary electromagnetic rave shielding structure of a magnetron for a microwave oven as claimed in claim 1, wherein said ferrite core is chosen such that in an equation for complex permeability: $\mu=\mu''-\mu\Delta$, where, $\mu$ is the complex permeability, $\mu'$ is magnetic permeability, and $\mu''$ is a loss value due to electric wave absorption, the term of $\mu''$ has a value in the range of $100\sim3000$ at the band zone of $11\sim13$ GHz.

5. An unnecessary electromagnetic wave shielding structure of a magnetron for a microwave oven as claimed in claim 1, wherein said second ferrite core is chosen such that in an equation for complex permeability: $\mu=\mu'-i\mu''$, the term of $\mu''$ has a value in the range of $100\sim3000$ at the band zone of $2\sim3$ GHz.

6. An unnecessary electromagnetic wave shielding structure of a magnetron for a microwave oven as claimed in claim 1, wherein said bent support of each said filament terminal is resilient to permit said insulator to be resiliently inserted between said second ferrite core and said bent support.

7. An unnecessary electromagnetic wave shielding structure of a magnetron for a microwave oven as slaimed in claim 1, wherein said insulator is comprised of an annular ceramic ring.

* * * * *